United States Patent [19]

Benjamin

[11] 4,290,154

[45] Sep. 22, 1981

[54] BATHTUB STRUCTURE

[75] Inventor: William H. Benjamin, Bellflower, Calif.

[73] Assignee: Benjamin Manufacturing Company, Inc., Paramount, Calif.

[21] Appl. No.: 93,889

[22] Filed: Nov. 13, 1979

[51] Int. Cl.[3] ..... A47K 3/02; A47K 3/16

[52] U.S. Cl. ..... 4/538; 4/584; 4/593; 4/595

[58] Field of Search ..... 4/593, 595, 538, 584

[56] References Cited

U.S. PATENT DOCUMENTS

| | | | |
|---|---|---|---|
| 1,995,045 | 3/1935 | Sundstrom | 4/595 |
| 2,528,432 | 10/1950 | Heckathorn | 4/595 |
| 2,697,231 | 12/1954 | Strand | 4/595 |
| 3,046,568 | 7/1962 | Holberson | 4/593 |
| 3,561,019 | 2/1971 | Roland | 4/593 |

*Primary Examiner*—Henry K. Artis

*Attorney, Agent, or Firm*—K. H. Boswell; Edward D. O'Brian

[57] ABSTRACT

A bathtub of the type having a bottom and four sides is improved by providing a smooth continuous, horizontally extending planar surface extending outwardly from the top of the four sides. A skirt member extends downwardly from this planar surface for a short distance. Located within the skirt member is a retaining member which is capable of retaining an apron panel in a fixed alignment with the tub such that the apron panel is interchangeable with the left and right sides of the tub allowing the tub to be used interchangeably in installations which previously required either a right or left handed tub. Extending along the longitudinal axis of the bottom of the tub is a runner retaining member to which is attached one or more runners which suspend the tub above a supporting surface allowing both drain and inlet pipes to be located between the supporting surface and the tub.

12 Claims, 7 Drawing Figures

BATHTUB STRUCTURE

BACKGROUND OF THE INVENTION

This invention is directed to an improved bathtub which includes an apron panel holding member located in a lip on the rim of the tub allowing an apron panel to be attached to either or both sides of the tub. Further, the tub is suspended from a supporting surface by one or more runners allowing the plumbing pipes associated with the tub to be located directly underneath a tub above a supporting surface.

With the advent of indoor plumbing, bathtubs were developed which included integrally formed drain holes allowing the tub to be conveniently drained. These tubs were generally supported on legs and were free-standing in their location. Further modifications of the tub yielded the built-in bathtub wherein the tub fit within a space or alcove within the bathroom. Because, however, the plumbing for draining the tub is located at one end or the other of the alcove it was necessary to supply both right and left hand tubs for proper location of the drain and the outwardly facing side in these built-in applications.

Generally most tubs are constructed of steel with enamel overlays. This resulted in a fixture which is quite heavy. With the recent boom in the mobile home market wherein weight is a factor to be considered in designing a mobile home, the use of extremely heavy fixtures is precluded. In a mobile home the plumbing cannot be located below the floor of the mobile home since this would place it on the bottom of the mobile home and therefore susceptible to road hazards when the mobile home is moved. This thus requires designers and builders of mobile homes to place the tub in a position in a mobile home dictated solely on where they can place the plumbing pipes and not dictated by design principles which allow for maximum utilization of living space and convenience of location of the tub for the owner of the mobile home.

Aside from the normal three-sided alcove placement of tubs many people prefer a sunken tub, a free-standing tub or possibly a tub only bordered against two or even just one wall. Each of these different locations of a tub presently require an individual tub which is solely designed only for that specific location, i.e., a sunken tub will be designed differently than a tub that is used against one wall, etc. This requires not only the manufacture of many different shapes and designs of tubs, but also requires a plumbing supply house to maintain a large inventory of diferent tubs each only utilizable in one particular construction. Because of the different shapes of these tubs shipping of these tubs is more costly because they cannot be orderly stacked and shipped within a small space but each almost requires its own separate packing container.

In view of the above discussion it is considered that there exists a need for an improved bathtub which can be utilized for a variety of installations including mobile home installations without regard to whether it will be placed against three walls, two walls, one wall, be a sunken tub or be a right or left handed tub. Further, there exists a need for a tub for mobile home installations which does not require the placement of a drain pipe below the structural support but which allows placement of the drain pipe between the structural support and the tub.

SUMMARY OF THE INVENTION

It is an object of this invention to provide an improved bathtub which fulfills the above outlined needs. It is a further object to provide a bathtub which can be shipped with a plurality of other tubs in a small container thus saving space and as a consequence shipping costs. With the reduction in shipping costs the overall cost to the consumer is thus reduced.

These and other objects which will become evident from a remainder of this specification are achieved by providing in a bathtub of the type having the bottom integrally formed with four sides and a drain opening located in the bottom an improvement which comprises: a smooth, continuous, horizontally extending essentially planar surface integrally formed with and extending outwardly from each of the four sides, a skirt member extending downwardly from the outer perimeter of said planar surface around all four sides of the tub for a distance corresponding to a portion of the height of the wall; the uppermost portion of said walls, said planar surface and said skirt together forming a downwardly opening channel extending around the periphery of the uppermost portion of the walls; a panel retaining means located in said channel and capable of retaining a panel in a fixed alignment with said tub; said panels optionally located at any of the four sides of the tub in any combination of one or more panels.

A tub holding means is used in combination with the skirt to fixedly attach the tub against a wall. Said tub holding means including a major elongated flat plate having an elongated flange projecting perpendicular to the major flat plate and located along the elongated edges of the major flat plate, a minor elongated flat plate attaching coplanar with said major elongated plate along the elongated edge of the flange distal from said major elongated plate, said minor elongated plate sized to extend upwardly from said flange for a portion of the width of the major elongated plate, an elongated rib extending outwardly from the major elongated plate along the length of the major elongated plate on the side wherein said flange is located parallel with the flange, the side of the elongated rib proximal to the flange shaped to mimic the shape of the edge of said tub wherein said planar surface meets said skirt, said tub holding means attaching to said tub such that said skirt fits into the cavity between the major elongated plate and the minor elongated plate, and said side of said rib shaped to mimic the edge of said tub fits against said edge of said tub and said area of said major elongated plate extending beyond said rib distal from said flange is available for nailing or otherwise fastening to a structural wall.

Said tub further includes a runner holding means located on the underside of the bottom of said tub and extending along the longitudinal axis of said tub; at least one runner member capable of interlocking with said runner holding means fixedly holding said runner to the underside of said bottom of said tub such that said tub is capable of being suspended above a supported surface by said runner member.

BRIEF DESCRIPTION OF THE DRAWINGS

The invention described in this specification will be better understood when taken in conjunction with the drawings wherein.

Figure 1:
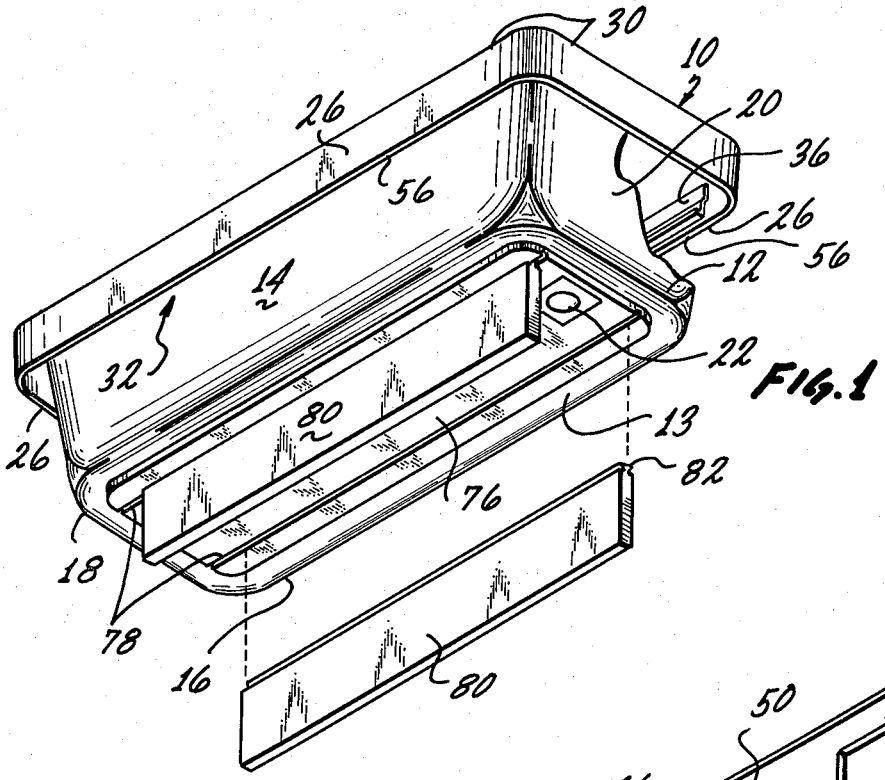
FIG. 1 is an isometric view of the underside of the bottom, one side and one end of the tub of this invention.

The invention described in this specification and shown in the drawings utilizes certain principles and concepts as are set forth and defined in the claims appended to this specification. Those skilled in the plumbing arts will realize that these principles and/or concepts can be used in a variety of differently appearing embodiments without departing from the spirit and scope of the claims. For this reason this invention is to be construed in light of the claims and is not to be construed as being limited to the exact embodiments described in the specification or illustrated in the drawings.

DETAILED DESCRIPTION

The bathtub 10 of this invention is illustrated as having a generally elongated rectangular shape. This particular shape finds the most utility in normal installations; however, the bathtub 10 is not to be construed as being limited to a rectangular shape. The principles of this invention are equally adaptable to other shapes such as a square shape, or a generally overall square shape having a triangular or trapezoidal arrangement of the walls and bottom. Further, the invention could also be expressed in an embodiment wherein the overall tub shape was round, oval, etc. For this reason in the embodiment shown the longitudinal axis or elongated axis is that axis along the length of the rectangular tub 10. However, if a square shape were used the longitudinal axis or elongated axis could be construed as either of the mutually perpendicular axes parallel to the square sides or even could be taken as the diagonal between opposite corners of the square shape.

Figure 4:
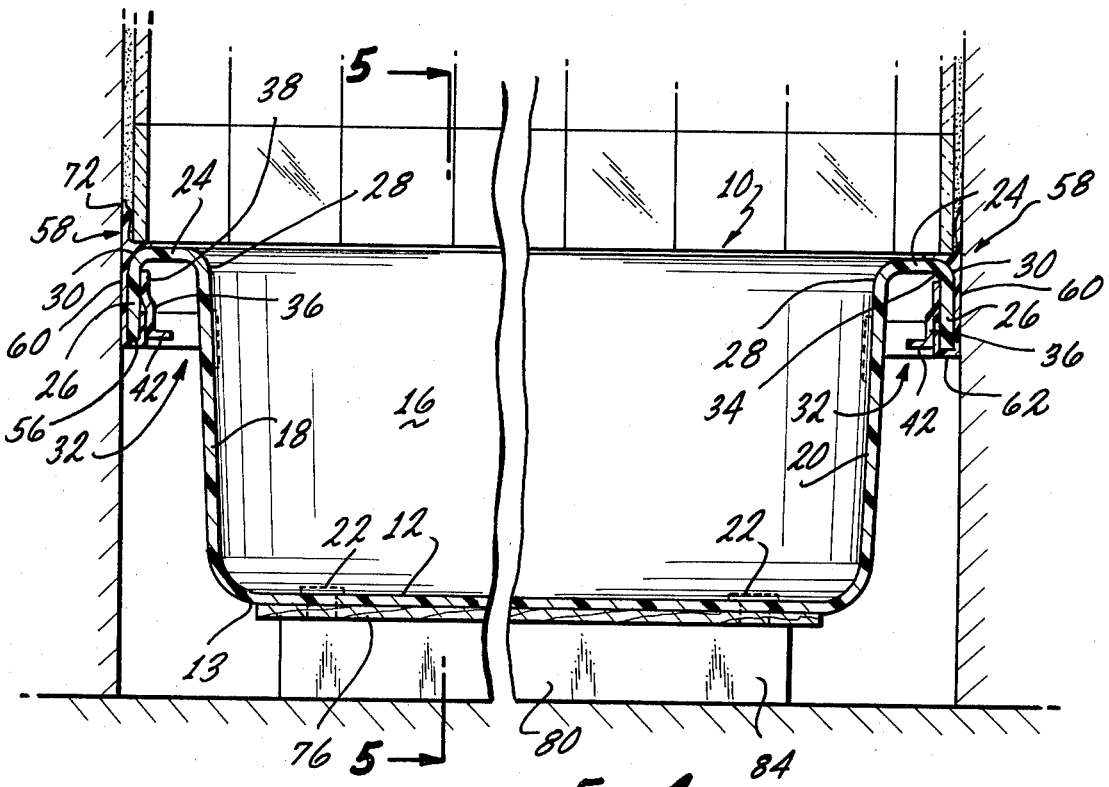
FIG. 4 is a side elevational view in section of the tub shown in FIG. 1 as installed in a structure.

The tub 10 illustrated has a bottom 12 having an underside 13. The four different sides of the tub—long sides 14 and 16 and short sides 18 and 20 (ends) are integrally formed with and attach to the bottom 12. Located in the bottom 12 is a drain opening 22. This drain opening 22 is as shown to be located in FIG. 1 near one end. As shown in FIG. 4 two drain openings 22 are shown in phantom because the tub 10 has no fixed outside surfaces and therefore can be turned 180° to locate the drain opening 22 at either the right or the left end of the bathtub 10.

Extending outwardly from each of the sides 14 through 20 is a horizontal planar surface 24. Extending downwardly from the perimeter of the planar surface 24 is a skirt 26. The skirt 26 extends completely around the perimeter of the tub 10 and its height is but a fraction of each of the walls. The edge 28 where the planar surface 24 meets the sides 14 through 20 is rounded and smooth. The edge 30 where the planar surface 24 meets the skirt 26 is also rounded and smooth.

Together the skirt 26, the planar surface 24 and the sides 14 through 20 form a channel 32 which opens downwardly. Located within the channel 32 on the inside 34 of the skirt 26 is an apron retaining member 36. A flat portion 38 of the apron retaining member 36 is solvent welded to the inside 34 of the skirt 26. The apron retaining member 36 then has an S shaped portion 40 which is integrally formed with portion 38 and also integrally formed with an L shaped portion 42 forming the remainder of the apron retaining member 36. The S shaped portion 40 holds the L shaped portion 42 a fixed distance away from the inside 34 of the skirt 26. Normally this distance is ⅛ of an inch; however, other distances can be chosen depending upon the individual circumstances for which the tub is manufactured.

The apron retaining member 36 is generally constructed of the same material as the tub 10 as hereinafter explained. This allows the apron retaining member 36 to be permanently solvent welded inside the channel 32. Depending upon whether the tub 10 will be placed within a three-sided enclosure, a two-sided enclosure, etc., or will be located within that portion of the channel 32 next to one or more of the sides 14 through 20. No matter what type of installation is utilized the apron retaining member 36 could be located completely around channel 32 except at its bends; however, in order to conserve materials it would normally only be located at those sides where it is needed. Because the apron retaining member 36 is simply solvent welded to the tub 10 it is not necessary to factory install it but it can be installed at the site of use by the workmen installing the tub 10.

Figure 2:
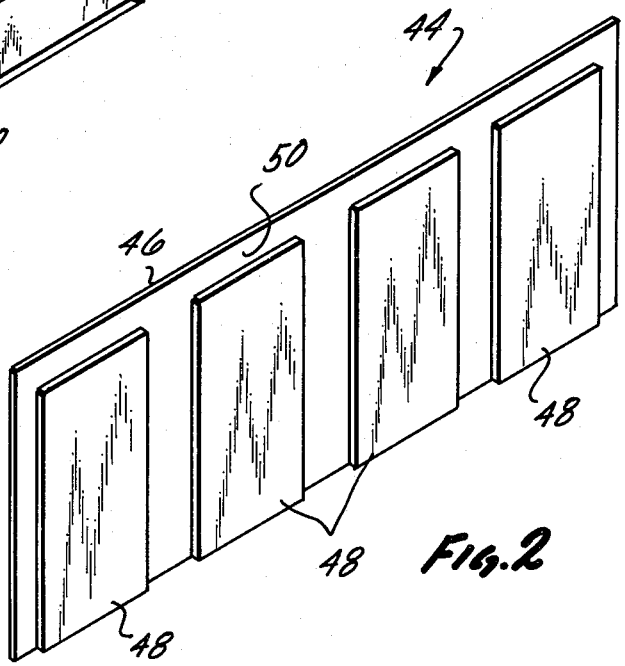
FIG. 2 is an isometric view of one embodiment of a panel to be used in conjunction with the tub shown in FIG. 1.
Figure 7:
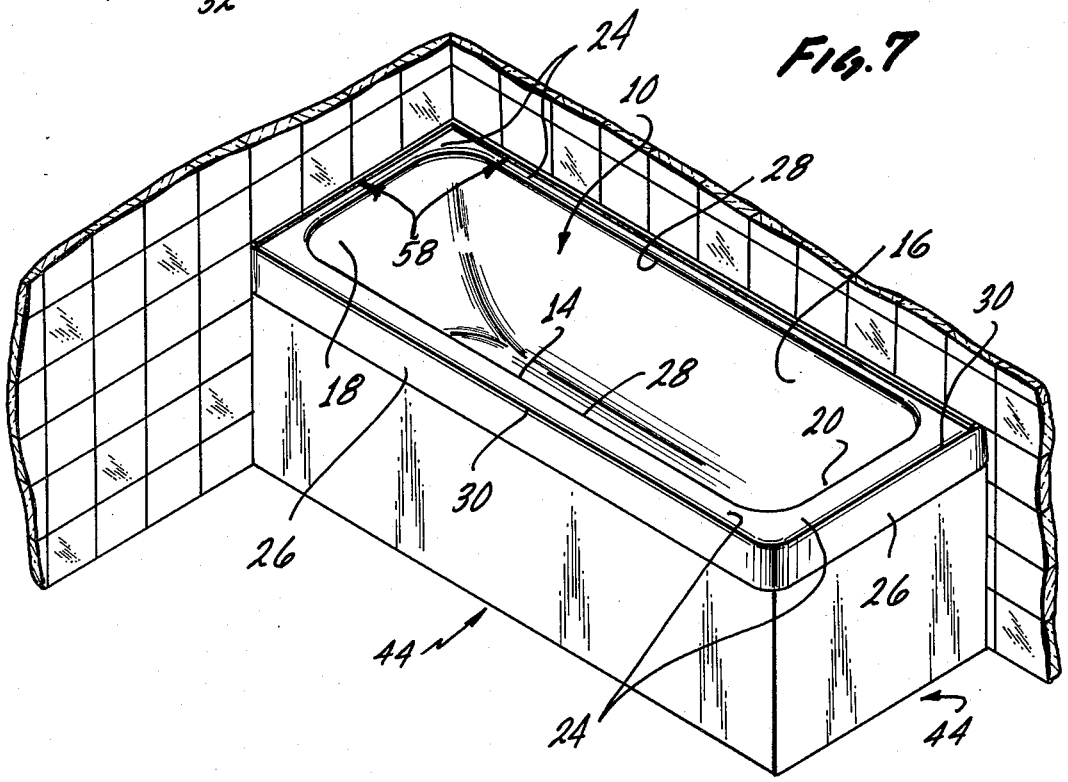
FIG. 7 is an isometric view of the tub of FIG. 1 showing the tub as installed against two walls.

The apron panel 44 shown in FIG. 2 is composed of a rectangular plate 46 which is normally one-eighth inch thick to match the spacing noted above between the L shaped portion 42 and the inside 34 of skirt 26. Suitably attached to plate 46 are a series of structural members 48. These structural members 48 are normally thicker than plate 46 to provide structural strength and are simply glued to plate 46. Their use is optional and instead of the embodiment shown in FIG. 2 wherein a plurality of structural members 48 are used, a continuous structural member 48 or a lesser or greater number of structural members 48 could alternately be used. In any event the uppermost portion 50 of the plate 46 slides in between the L shaped portion 42 of the apron retaining member 36 and the inside 34 of skirt 26. If a three-sided alcove is used such as that in FIGS. 4 and 5 one apron panel 44 is used on the one exposed side of the tub 10. For the embodiment shown in FIG. 7 wherein a two-sided enclosure is illustrated, a long apron panel 44 is used along the longest side of the tub 10 and a short apron panel 44 is used along the short side of the tub 10.

If the tub 10 were free-standing four apron panels 44 would be used—two identical long apron panels 44 and two identical short apron panels 44.

The tub 10 can also be utilized as a sunken tub. In this application no apron panels 44 would be used but the tub 10 would be appropriately placed in an appropriately shaped hole such that the bottom edge 56 of the skirt 26 would fit flush against the top of the surface in which the tub 10 is sunken.

Because the apron 44 is not fixedly attached to the tub 10 during manufacture the tub 10 can conveniently be turned in its installation space to locate the drain opening 22 in any direction desired.

Figure 3:
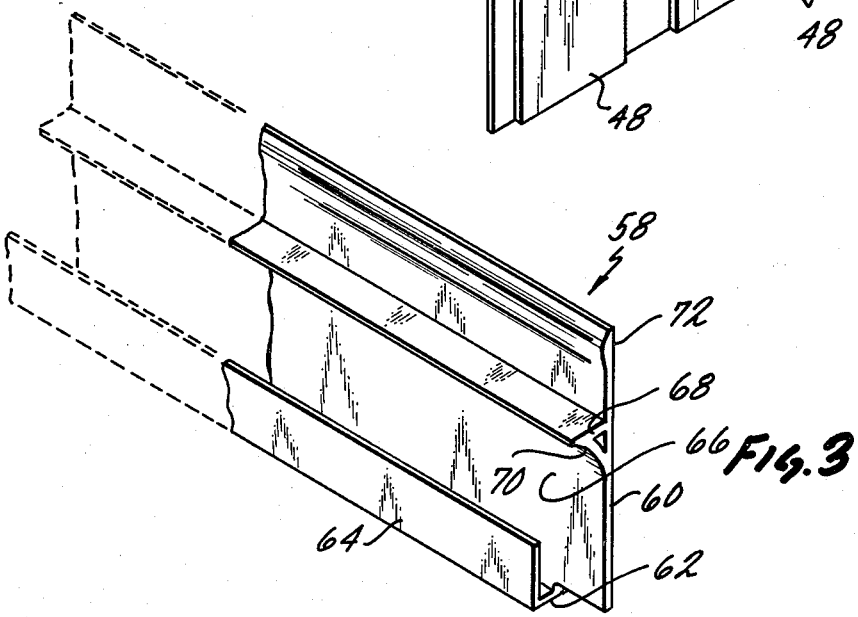
FIG. 3 is an isometric view of one embodiment of a holding strip to be used in conjunction with the tub shown in FIG. 1.

When the tub 10 is to be located next to one or more walls a holding strip 58 is utilized. As shown in FIG. 3 the holding strip 58 consists of an elongated flat major plate 60 having a flange 62 located on one edge. The flange 62 extends perpendicular from the major plate 60. Attaching along the other edge of the flange 62 is a minor plate 64. Minor plate 64 is coplanar with major plate 60 and extends upwardly from flange 62 for a portion of the width of major plate 60. Running along side 66 of major plate 60 (the side on which the minor plate 64 is located) is a rib 68. Rib 68 runs parallel with flange 62. One side 70 of rib 68 is given a concave curve which mimics edge 30.

Figure 5:
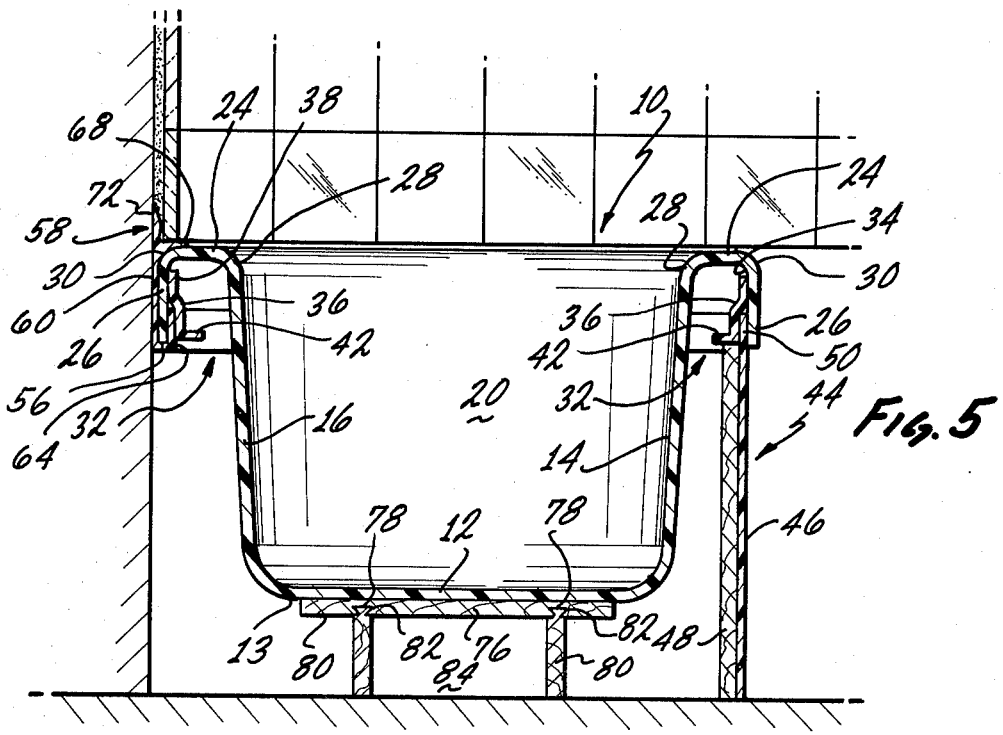
FIG. 5 is an end elevational view in section of the tub shown in FIG. 4.
Figure 6:
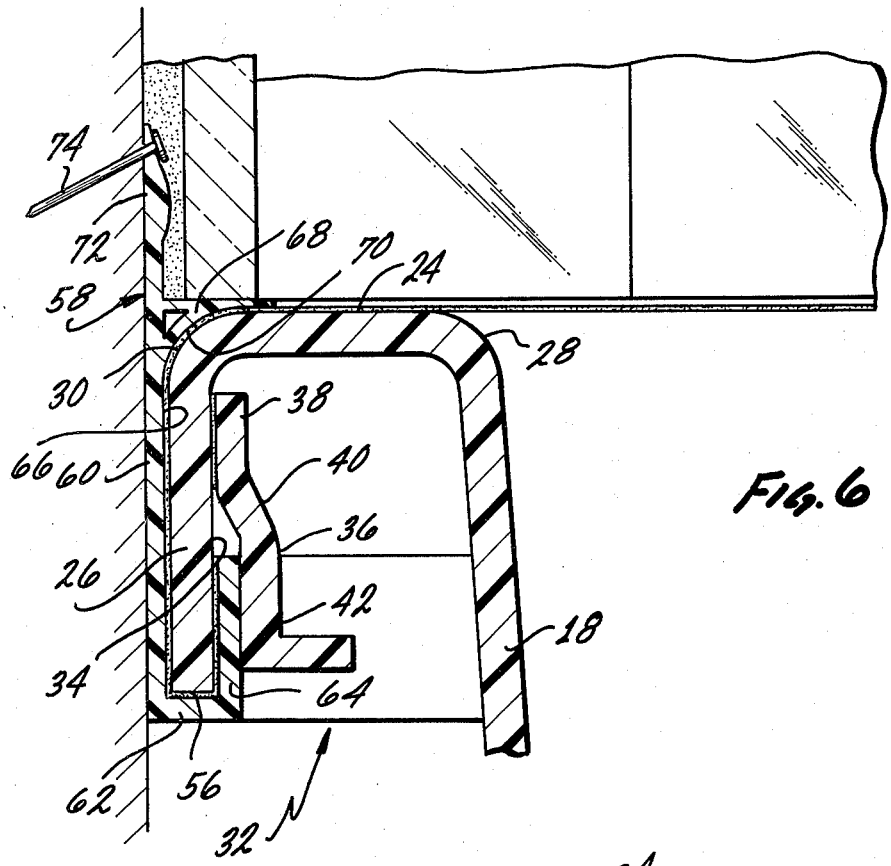
FIG. 6 is a portion of FIG. 5 enlarged to show in greater detail the upper part of the left hand side of the tub shown in FIG. 5.

As shown in FIGS. 4, 5 and 6 the holding strip 58 is mounted against the skirt 26 such that a portion of the skirt 26 fits between minor plate 64 and major plate 60 and abuts against flange 62. This locates the curved sides 70 against the edge 30 such that the skirt 26 is closely enclosed within the holding strip 58. The portion 72 of the major plate 60 extending above the rib 68 is now conveniently available to be used as a surface to lock the tub 10 to the structural walls by passing nails 74 through portion 72 as shown in FIG. 6. Aside from nails other equivalent fasteners could alternately be used.

Dry wall, tiles or panels can now be conveniently located over portion 72 completing the walls around the tub 10. While it is not considered necessary for maintaining proper locking of holding strip 58 to skirt 26, the minor plate 64 will conveniently fit under the apron retaining member 36. This forms a further lock of the holding strip 58 to the tub 10. The holding strip 58 additionally can be solvent welded to the skirt 26 when it is located about the skirt 26. This too forms a further strengthening effect between the holding strip 58 and the tub 10.

Located on the underside 13 of bottom 12 is a runner holding member 76. As illustrated in the embodiment illustrated in the figures the runner holding member 76 is a flat plate adapted to fit against the bottom 12 and be glued thereon. The runner holding member 76 includes an appropriate extension of drain opening 22. Running along the longitudinal axis of the runner holding member 76 are two grooves both identified by the numeral 78. In cross-section these grooves 78 have a trapezoid-like shape wherein the opening is smaller than the bottom of the groove 78. Two runners both identified by the numeral 80 each include a trapezoid-shaped tongue 82 along one of their edges. The tongues 82 are shaped within the grooves 78 when the runners 80 are slid from one end of the runner holding member 76 to the other. This fixedly locks the runner 80 to the runner holding member 76. Along with the tongue and groove type locking arrangement normally glue is also spread within the grooves 78 prior to insertion of the tongues 82. This forms a very strong bond between the runners 80 and the runner holding member 76.

The runners 80 can be sized and shaped as needed. Thus, if the tub 10 is to be supported at a considerable height above a floor or other sub-structure the runners 80 will be quite wide. If the tub 10 is to be mounted lower or closer to the sub-structure the runners 80 will correspondingly be narrower. Further, if the tub 10 is to be mounted in a mobile home installation where a cross-beam crosses underneath the tub the runners 80 can be appropriately notched to incorporate the location of the tub 10 over the cross-beam.

When manufactured the tub 10 generally has a slope toward the drain opening 22. Normally the runners 80 will not be perfectly rectangular in shape but will also slope toward one end with a slope equal to the slope of the tub 10. The runners 80 will then be inserted into the runner holding member 76 such that their wide end is positioned proximal to the drain opening 22 and their narrow end is positioned distal to the drain opening 22. This will result in the bottom edges of the runners 80 being in exact parallel alignment with the planar surface 24 of the tub 10 and will facilitate level installation of the tub 10.

In the embodiment illustrated two runners 80 are used. This results in a space 84 being formed between the two runners 80. The space 84 can be used as a space for the drain pipe (not shown or numbered) to traverse underneath the tub 10. Thus, it is not necessary for the drain pipe to be located below the supporting structure. Further, the hot and cold water inlet pipes can also be passed underneath the tub 10 through the space 84. When utilizing the tub 10 in a mobile home installation this facilitates the locating of all of the plumbing within the interior of the mobile home protecting these pipes.

Normally the tub 10 will be vacuum formed from a suitable thermoplastic such as a combination of ABS and acrylic. Other materials could be used such as fiberglass or the equivalent. The holding strip 58 is suitably formed by extrusion molding or the like out of suitable material such as a thermoplastic and the like. The runner holding member 76 and the runners 80 will preferably be a pressed board or plywood as will be the structural members 48 used in the apron panel 44. The plate 46 used in the apron panel 44 can be identical to the material used in the tub 10 or it can be any other suitable paneling material which itself has a decorative motif on its surface or which will form the foundation for overlaying with ceramic tiles and the like. The apron retaining member 36 will be formed of a suitable thermoplastic compatible with that used in the tub 10 such that the apron retaining member 36 can be solvent welded inside the skirt 26.

Because the runners 80 and the apron panels 44 are detachable from the body of the tub 10, during shipping the bodies of the tubs can be conveniently stacked one within another and the runners 80 and apron panels 44 can be conveniently stacked one upon another and located in the void spaces of the shipping carton. When shipped in this manner generally eight tubs can be shipped in the space required by five tubs not having these features.

I claim:

1. In a bathtub having a bottom integrally formed with four sides and a drain opening located in the bottom an improvement which comprises:

a smooth, continuous horizontally extending essentially planar surface integrally formed with and extending outwardly from each of the four sides;

a skirt member extending downwardly for a portion of the vertical height of the sides from the outer perimeter of said planar surface around said sides of said tub;

the uppermost portion of said walls, said planar surface and said skirt together forming a downwardly opening channel extending around the periphery of the uppermost portion of said walls;

a panel retaining means located in its entirety in said channel and capable of retaining a panel in a fixed alignment with said tub.

2. The tub of claim 1 wherein:

said panel retaining means comprises a panel holding member mounted on the inside wall of said skirt member and including a portion of said panel holding member spaced away from said inside wall of said skirt in parallel relationship with said skirt such that a panel can be inserted between said skirt and said portion spaced away from said skirt and be frictionally maintained therein.

3. The tub of claim 2 including:

a panel having an upper edge sized to fit between said skirt and said portion spaced away from said skirt.

4. In a bathtub having a bottom integrally formed with four sides and a drain opening located in the bottom an improvement which comprises:

a smooth, continuous horizontally extending essentially planar surface integrally formed with and extending outwardly from each of the four sides;

a skirt member extending downwardly for a portion of the vertical height of the sides from the outer perimeter of said planar surface around said sides of said tub;

the uppermost portion of said walls, said planar surface and said skirt together forming a downwardly opening channel extending around the periphery of the uppermost portion of said walls;

a panel retaining means located in said channel and capable of retaining a panel in a fixed alignment with said tub;

a tub holding means having a major elongated flat plate, said major plate including an elongated flange projecting perpendicular to said major plate along one of the elongated edges of said major plate, a minor elongated flat plate attaching coplanar with said major plate along said flange, said minor plate sized to extend upwardly from said flange for a portion of the width of said major plate, an elongated rib extending outwardly from said major plate along the length of said major plate on the same side of said a skirt member extending downwardly for a portion of the vertical height of the sides from the outer perimeter of said planar surface around said sides of said tub;

the uppermost portion of said walls, said planar surface and said skirt together forming a downwardly opening channel extending around the periphery of the uppermost portion of said walls;

a panel retaining means located in said channel and capable of retaining a panel in a fixed alignment with said tub.

5. In a bathtub having a bottom integrally formed with four sides and a drain opening located in the bottom an improvement which comprises:

a runner holding means located on the underside of said bottom and extending along the longitudinal axis of said tub;

at least one runner member capable of interlocking with said runner holding means fixedly holding said runner along the longitudinal axis of said tub such that the bottom of said tub is capable of being suspended above a supportive surface by said runner member.

6. The tub of claim 5 including:

two runners capable of being fixedly held by said runner means such that said runners are located in substantially a parallel relationship along the longitudinal axis of said tub and said drain is located between said runners.

7. The tub of claim 6 wherein:

said runner holding means comprises an elongated flat member fixedly attaching to the undersurface of said bottom, said elongated flat member including two parallel spaced grooves running along the longitudinal axis of said elongated flat member, the opening of said groove having a smaller dimension than the dimension between the walls of said groove along the bottom of said groove such that said groove has a trapezoid like shape when viewed in cross-section;

each of said runners comprising an elongated rectangular shaped member including a tongue running along the length of one of the elongated edges, the shape of said tongue complementary to the shape of said grooves in said elongated flat member such that said runner can be attached to said flat member by inserting one end of said tongue in one end of said groove and sliding said tongue along the length of said groove.

8. In a bathtub having a bottom integrally formed with four sides and a drain opening located in the bottom an improvement which comprises:

a runner holding means located on the underside of said bottom and extending along the longitudinal axis of said tub;

at least one runner member capable of interlocking with said runner holding means fixedly holding said runner along the longitudinal axis of said tub such that the bottom of said tub is capable of being suspended above a supportive surface by said runner member;

a smooth, continuous horizontally extending essentially planar surface integrally formed with and extending outwardly from each of the four sides; of said walls;

a panel retaining means located in said channel and capable of retaining a panel in a fixed alignment with said tub;

said panel retaining means comprises a panel holding member mounted on the inside wall of said skirt member and including a portion of said panel holding member spaced away from said inside wall of said skirt in parallel relationship with said skirt such that a panel can be inserted between said skirt and said portion spaced away from said skirt and be frictionally maintained therein;

a runner holding means located on the underside of said bottom and extending along the longitudinal axis of said tub;

at least one runner member capable of interlocking with said runner holding means fixedly holding said runner along the longitudinal axis of said tub such that the bottom of said tub is capable of being suspended above a supportive surface by said runner member.

9. The tub of claim 8 wherein:

said panel retaining means comprises a panel holding member mounted on the inside wall of said skirt member and including a portion of said panel holding member spaced away from said inside wall of said skirt in parallel relationship with said skirt such that a panel can be inserted between said skirt and said portion spaced away from said skirt and be frictionally maintained therein;

and including, two runners capable of being fixedly held by said runner means such that said runners are located in substantially a parallel relationship along the longitudinal axis of said tub and said drain is located between said runners.

10. In a bathtub having a bottom integrally formed with four sides and a drain opening located in the bottom an improvement which comprises:

a smooth, continuous horizontally extending essentially planar surface integrally formed with and extending outwardly from each of the four sides;

a skirt member extending downwardly for a portion of the vertical height of the sides from the outer perimeter of said planar surface around said sides of said tub;

the uppermost portion of said walls, said planar surface and said skirt together forming a downwardly opening channel extending around the periphery of the uppermost portion major plate where said flange is located, the side of said elongated rib proximal to said flange shaped to mimic the shape of said edge of said tub wherein said planar surface meets said skirt, said tub holding means attaching to said tub such that said skirt fits within said cavity between said major plate and said minor plate and said side of said rib shaped to mimic said edge of said tub fits against said edge of said tub wherein said planar surface meets said skirt.

11. The tub of claim 10 including:

two runners capable of being fixedly held by said runner means such that said runners are located in substantially a parallel relationship along the longitudinal axis of said tub and said drain is located between said runners; and wherein, said runner holding means comprises an elongated flat member fixedly attaching to the undersurface of said bottom, said elongated flat member including two parallel spaced grooves running along the longitudinal axis of said elongated flat member, the opening of said groove having a smaller dimension than the dimension between the walls of said groove along the bottom of said groove such that said groove has a trapezoid like shape when viewed in cross-section;

each of said runners comprising an elongated rectangular shaped member including a tongue running along the lengths of one of the elongated edges, the shape of said tongue complementary to the shape of said grooves in said elongated flat member such that said runner can be attached to said flat member by inserting one end of said tongue in one end of said groove and sliding said tongue along the length of said groove.

12. The tub of claim 10 including:

a tub holding means having a major elongated flat plate, said major plate including an elongated flange projecting perpendicular to said major plate along one of the elongated edges of said major plate, a minor elongated flat plate attaching coplanar with said major plate along said flange, said minor plate sized to extend upwardly from said flange for a portion of the width of said major plate, an elongated rib extending outwardly from said major plate along the length of said major plate on the same side of said major plate where said flange is located, the side of said elongated rib proximal to said flange shaped to mimic the shape of said edge of said tub wherein said planar surface meets said skirt, said tub holding means attaching to said tub such that said skirt fits within said cavity between said major plate and said minor plate and said side of said rib shaped to mimic said edge of said tub fits against said edge of said tub wherein said planar surface meets said skirt.

* * * * *

UNITED STATES PATENT AND TRADEMARK OFFICE

CERTIFICATE OF CORRECTION

PATENT NO. : 4,290,154

DATED : September 22, 1981

INVENTOR(S) : William H. Benjamin

It is certified that error appears in the above—identified patent and that said Letters Patent is hereby corrected as shown below:

Delete Claim 4 as printed and insert in its stead the following, corrected Claim 4:

4. In a bathtub having a bottom integrally formed with four sides and a drain opening located in the bottom an improvement which comprises:

a smooth, continuous horizontally extending essentially planar surface integrally formed with and extending outwardly from each of the four sides;

a skirt member extending downwardly for a portion of the vertical height of the sides from the outer perimeter of said planar surface around said sides of said tub;

the uppermost portion of said walls, said planar surface and said skirt together forming a downwadly opening channel extending around the periphery of the uppermost portion of said walls;

panel retaining means located in said

PATENT NO. : 4,290,154
DATED : September 22, 1981
INVENTOR(S) : William H. Benjamin It is certified that error appears in the above—identified patent and that said Letters Patent is hereby corrected as shown below:

channel and capable of retaining a panel in a fixed alignment with said tub;

a tub holding means having a major elongated flat plate, said major plate including an elongated flange projecting perpendicular to said major plate along one of the elongated edges of said major plate, a minor elongated flat plate attaching coplanar with said major plate along said flange, said minor plate sized to extend upwardly from said flange for a portion of the width of said major plate, an elongated rib extending outwardly from said major plate along the length of said major plate on the same side of said major plate where said flange is located, the side of said elongated rib proximal to said flange shaped to mimic the shape of said edge of said tub wherein said planar surface meets said skirt, said tub holding means attaching to said tub such that said skirt fits within said cavity between said major plate and said minor plate and said side of said rib shaped to mimic said edge of said tub fits

UNITED STATES PATENT AND TRADEMARK OFFICE

CERTIFICATE OF CORRECTION

PATENT NO. : 4,290,154

DATED : September 22, 1981

INVENTOR(S) : William H. Benjamin

It is certified that error appears in the above-identified patent and that said Letters Patent is hereby corrected as shown below:

against said edge of said tub wherein said planar surface meets said skirt.

Delete claim 8 as printed, and in its stead insert the following, corrected Claim 8:

8. In a bathtub having a bottom integrally formed with four sides and a drain opening located in the bottom an improvement which comprises:

a runner holding means located on the underside of said bottom and extending along the longitudinal axis of said tub;

at least one runner member capable of interlocking with said runner holding means fixedly holding said runner along the longitudinal axis of said tub such that the bottom of said tub is capable of being suspended above a supportive surface by said runner member;

a smooth, continuous horizontally extending essentially planar surface integrally formed with and extending outwardly from each of

UNITED STATES PATENT AND TRADEMARK OFFICE

CERTIFICATE OF CORRECTION

PATENT NO. : 4,290,154

DATED : September 22, 1981

INVENTOR(S) : William H. Benjamin

It is certified that error appears in the above-identified patent and that said Letters Patent is hereby corrected as shown below:

the four sides;

a skirt member extending downwardly for a portion of the vertical height of the sides from the outer perimeter of said planar surface around said sides of said tub;

the uppermost portion of said walls, said planar surface and said skirt together forming a downwardly opening channel extending around the periphery of the uppermost portion of said walls;

a panel retaining means located in said channel and capable of retaining a panel in a fixed alignment with said tub.

Delete claim 10 as printed and in its stead insert the following, corrected Claim 10:

10. In a bathtub having a bottom integrally formed with four sides and a drain opening in the bottom an improvement which comprises:

a smooth, continuous horizontally extending essentially planar surface integrally

UNITED STATES PATENT AND TRADEMARK OFFICE

CERTIFICATE OF CORRECTION

PATENT NO. : 4,290,154

DATED : September 22, 1981

INVENTOR(S) : William H. Benjamin

It is certified that error appears in the above-identified patent and that said Letters Patent is hereby corrected as shown below:

formed with and extending outwardly from each of the four sides;

a skirt member extending downwardly for a portion of the vertical height of the sides from the outer perimeter of said planar surface around said sides of said tub;

the uppermost portion of said walls, said planar surface and said skirt together forming a downwardly opening channel extending around the periphery of the uppermost portion of said walls;

a panel retaining means located in said channel and capable of retaining a panel in a fixed alignment with said tub;

said panel retaining means comprises a panel holding member mounted on the inside wall of said skirt member and including a portion of said panel holding member spaced away from said inside wall of said skirt in parallel relationship with said skirt such that a panel can be inserted between said skirt and said portion spaced away from said skirt and be frictionally

UNITED STATES PATENT AND TRADEMARK OFFICE

CERTIFICATE OF CORRECTION

PATENT NO. : 4,290,154

DATED : September 22, 1981

INVENTOR(S) : William H. Benjamin

It is certified that error appears in the above-identified patent and that said Letters Patent is hereby corrected as shown below:

maintained therein;

a runner holding means located on the underside of said bottom and extending along the longitudinal axis of said tub;

at least one runner member capable of interlocking with said runner holding means fixedly holding said runner along the longitudinal axis of said tub such that the bottom of said tub is capable of being suspended above a supportive surface by said runner member.

Signed and Sealed this

*Thirteenth* Day of *March 1984*

[SEAL]

*Attest:*

GERALD J. MOSSINGHOFF

*Attesting Officer*

*Commissioner of Patents and Trademarks*